US006058540A

United States Patent [19]

Ryall

[11] Patent Number: 6,058,540

[45] Date of Patent: May 9, 2000

[54] POOL COVER CLEANER

[76] Inventor: John Ryall, 79 West St., Ballston Spa, N.Y. 12020

[21] Appl. No.: 09/063,726

[22] Filed: Apr. 24, 1998

[51] Int. Cl.[7] ..... A46B 11/06; E04H 4/16

[52] U.S. Cl. ..... 15/1.7; 401/289

[58] Field of Search ..... 15/1.7; 401/289

[56] References Cited

U.S. PATENT DOCUMENTS

| | | | |
|---|---|---|---|
| 1,012,040 | 12/1911 | Watts | 137/140 |
| 1,317,324 | 9/1919 | Scoville | 137/152 |
| 1,452,976 | 4/1923 | Lichtenstein | 401/289 |
| 2,707,293 | 5/1955 | Ferrer | 401/289 |
| 2,977,613 | 4/1961 | Mikulas | 15/1.7 |
| 3,008,160 | 11/1961 | West | 15/1.7 |
| 3,273,187 | 9/1966 | Williams | 15/1.7 |
| 5,152,026 | 10/1992 | Scarpine | 15/1.7 |

*Primary Examiner*—Mark Spisich
*Assistant Examiner*—Theresa T. Snider

[57] ABSTRACT

A pool cover cleaner for cleaning a pool cover through a siphoning process is provided for use on above ground pools. The pool cover cleaner has a brush which scrubs the cover during removal of water from the surface of the pool.

6 Claims, 4 Drawing Sheets

POOL COVER CLEANER

FIELD OF THE INVENTION

This invention relates to pool cover cleaners and, more particularly, to pool cover cleaners allowing a pool cover to be cleaned through the use of a pool cover cleaner device that uses a water supply to create siphoning action in a hose for removing water from the top of a pool cover.

DESCRIPTION OF THE PRIOR ART

Swimming pool covers for in ground or above ground pools are difficult to clean after bad weather leaves the cover with a large body of water, dirt and leaves. Before the cover can be removed from the pool, the cover must be cleaned as it rests on the pool. Because most pool covers are only supported from the sides of the pool, the cover can only withstand a limited amount of pressure on the top surface. For this reason the weight of a cleaner for cleaning a pool cover is limited to the amount of pressure the support system of the cover can withstand.

Previous attempts to clean pool covers include the use of pumps which are bulky, hard to handle and often too heavy for cover supports. Moreover, most pump cleaners are difficult to lift if they are extended to the center of the pool cover. The user generally must pull the pump directly back to the edge of the pool before repositioning the pump on a different area.

Siphon pumps for use on pool covers to drain the water are also well known. Unfortunately, siphon pumps with extended vacuum tubes and drain inlets fail to remove dirt and leaves from the cover. Siphon pump devices for cleaning pool covers further fail to provide a means for cleaning the surface by a scrubbing action with leads to dirt and algae build-up on the cover.

Well known cleaning devices which use siphoning or vacuum action are disclosed in U.S. Pat. Nos. 2,977,613, 1,317,324, 3,273,187, 3,795,027, 1,012,040, 3,008,160, 5,152,026. While some of these patents show cleaners with brushes, the prior art fails to provide a pool cover cleaner that effectively cleans the pool cover as it lies in place over the pool.

SUMMARY OF THE INVENTION

The basic purpose of this invention was to clean an above ground swimming pool cover.

This problem is solved by a pool cover cleaner which is lightweight, does not require an electric pump, works off a standard garden hose and is safe for use by all ages.

According to a preferred embodiment, a pool cover cleaner includes a handle, a hose, a water supply source and a cleaning head with a removable fluid delivery and removal section.

It is a further object of the invention to provide a pool cover cleaner having a brush for scrubbing a pool cover during the cleaning process.

It is yet a further object of the present invention to provide a pool cover cleaner having a head for adding additional cleaning fluids during the cleaning process.

DETAILED DESCRIPTION OF THE DRAWINGS

DESCRIPTION OF THE PREFERRED EMBODIMENT

Figure 1:
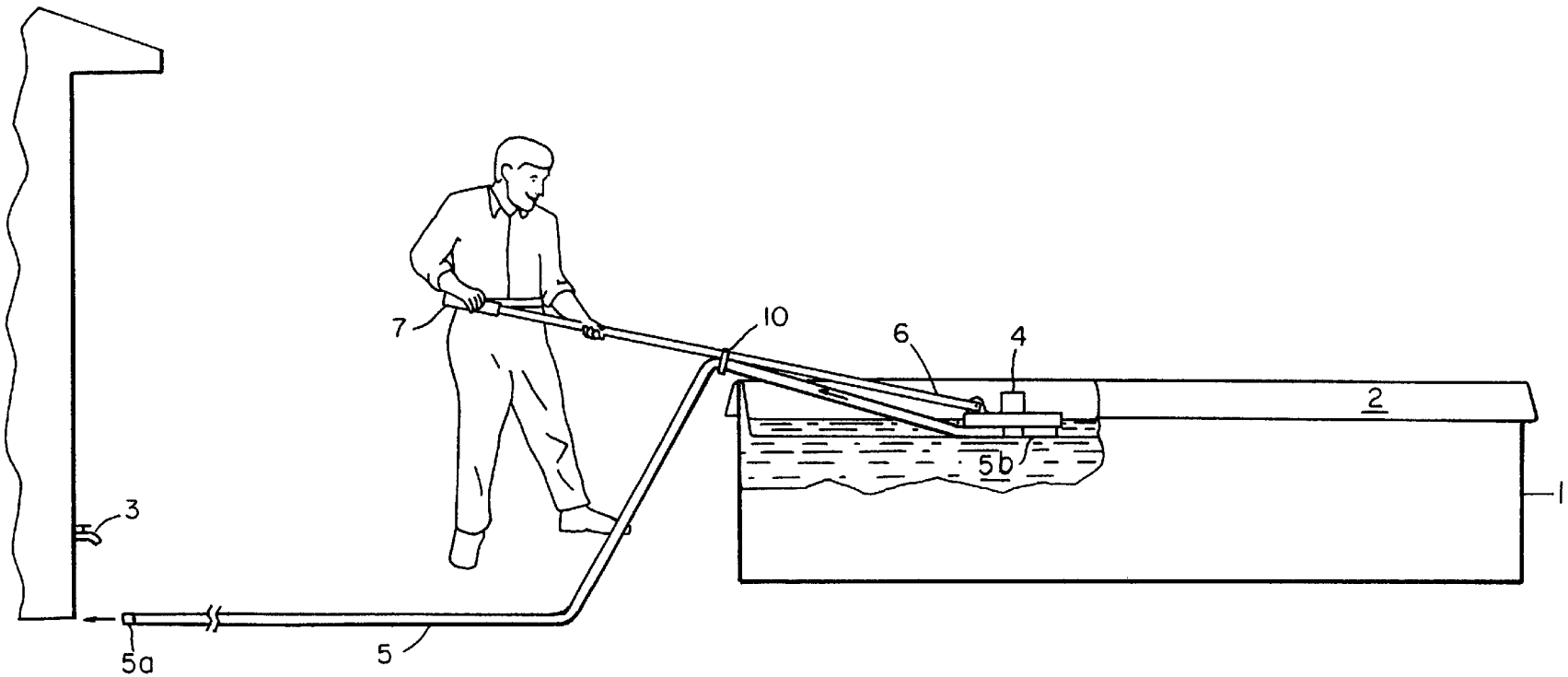
FIG. 1 is a plan view of a novel pool cleaner, a water supply source and an above ground pool.

As illustrated in the embodiment shown in FIGS. 1–6, an above ground pool 1 is illustrated and is provided with a pool cover 2. The pool 1 is located near a water outlet 3 that supplies water for use with pool cover cleaner 4. The water outlet is provided with means for connection to a hose 5. The hose has a first end 5*a* for connection to a water supply source and a second end 5*b* for connection to the pool cover cleaner 4.

The pool cover cleaner 4 is illustrated in FIG. 1 in use and positioned on the pool cover 2 for removing water and scum from the pool cover. The pool cover cleaner 4 includes a handle 6 having a hand grip 7. The handle 6 may be made of any lightweight material such as plastic or aluminum. The handle 6 is pivotally connected to a cleaner head and bound to a hose by an adjustable band 10 that is slidable along the handle 6 and the hose 5 for adjusting the connection point between the handle and the hose. The adjustable band permits the use of the cleaner along the pool cover at different angles without the hose laying on the edge of the pool sides.

Figure 2:
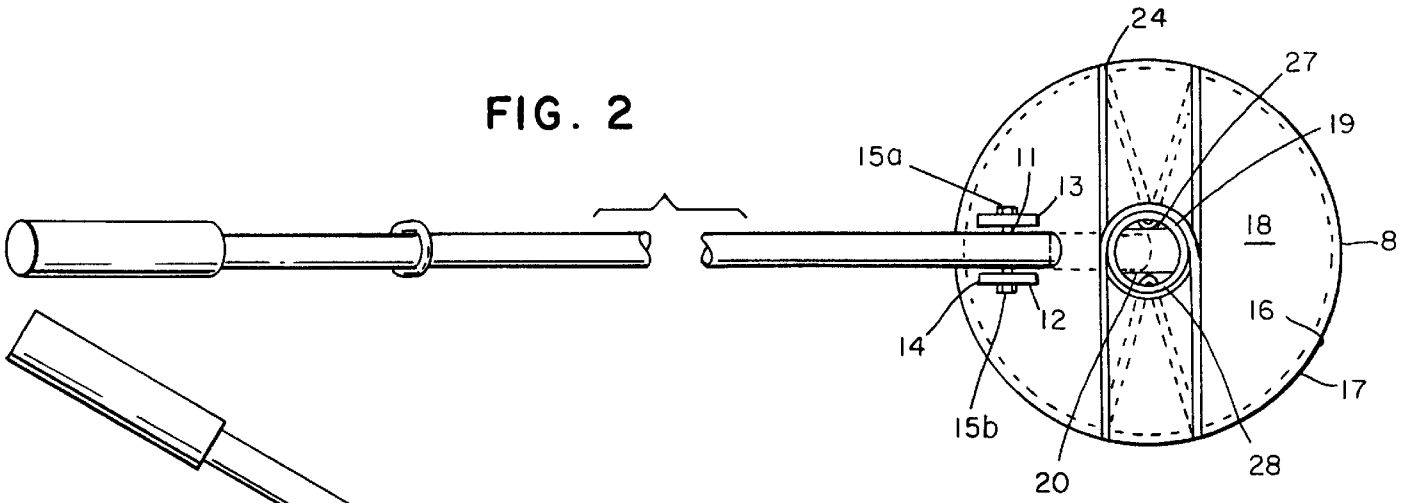
FIG. 2 is a top view of the pool cleaner.
Figure 3:
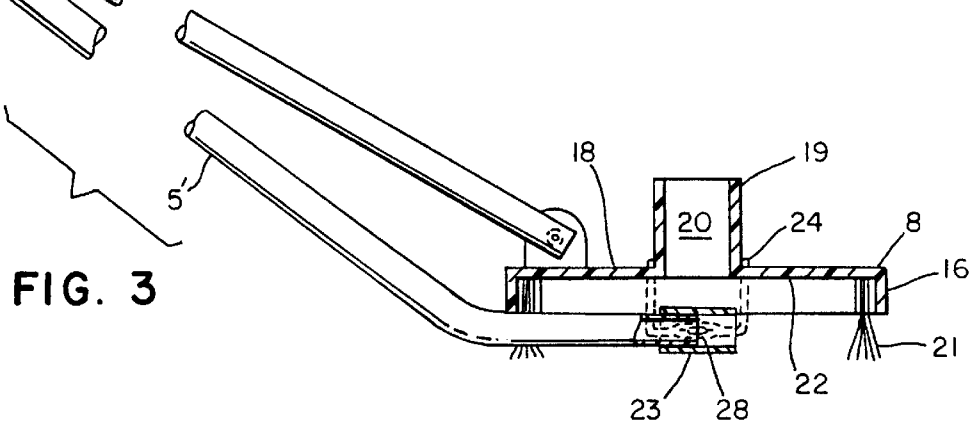
FIG. 3 is a partial sectional view of the pool cleaner head.

A top view of the pool cleaner head and handle is shown in FIG. 2. The handle is pivotally connected to the head by a connector 11 that includes a pair of flange members 12, 13 each having an aperture for receiving a pin 14 that passes through an end of the handle and is secured by nuts 15*a*, 15*b*. The connector 11 permits pivotal movement of the handle so that the user may move the head inward toward the edge of the pool or outward towards the center of the pool. The head 8 has a housing 16 with a frame edge 17 and a top surface 18 having a central center section 19 that provides an opening 20 through the center of the head. As shown in FIG. 3, the head 8 has a brush 21 for scrubbing the pool cover 2. The brush is attached on bottom surface 22 of the housing 16. As illustrated in FIG. 3, the hose 5 and handle 6 are secured by a band 10. The hose 5 extends under the head 8 and includes a fluid delivery and removal section 23 secured to the second end 5*b* of the hose 5. Section 23 is removably connected to the head by a resilient member 24. The fluid delivery and removal section 23 has a pair of eyelets 28 and 27 which are shown in FIG. 2. The eyelets receive the resilient member 24 for securing the hose end to the head 6 substantially under central center section 19.

Figure 4:
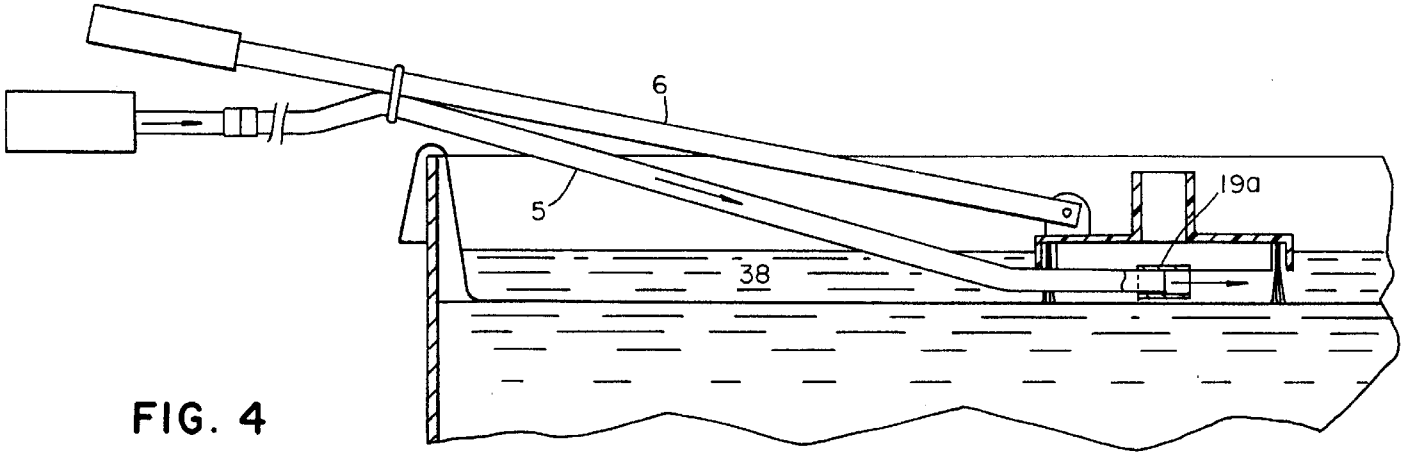
FIG. 4 is a partial sectional view of the pool cleaner with a water supply in the filling position.
Figure 5:
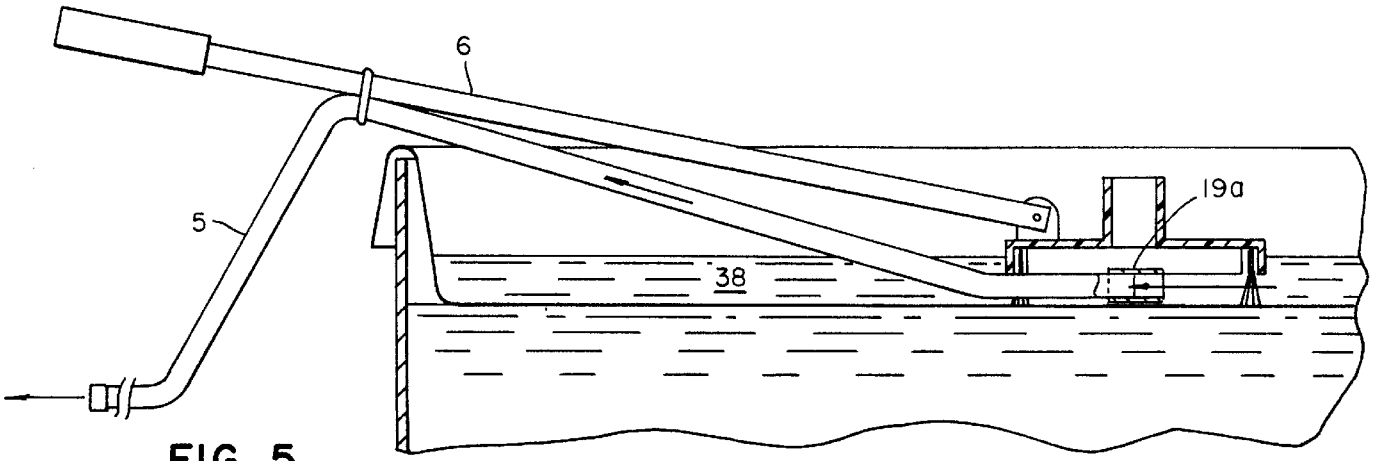
FIG. 5 is a partial sectional view of the pool cleaner with a water supply in the cleaning position.
Figure 6:
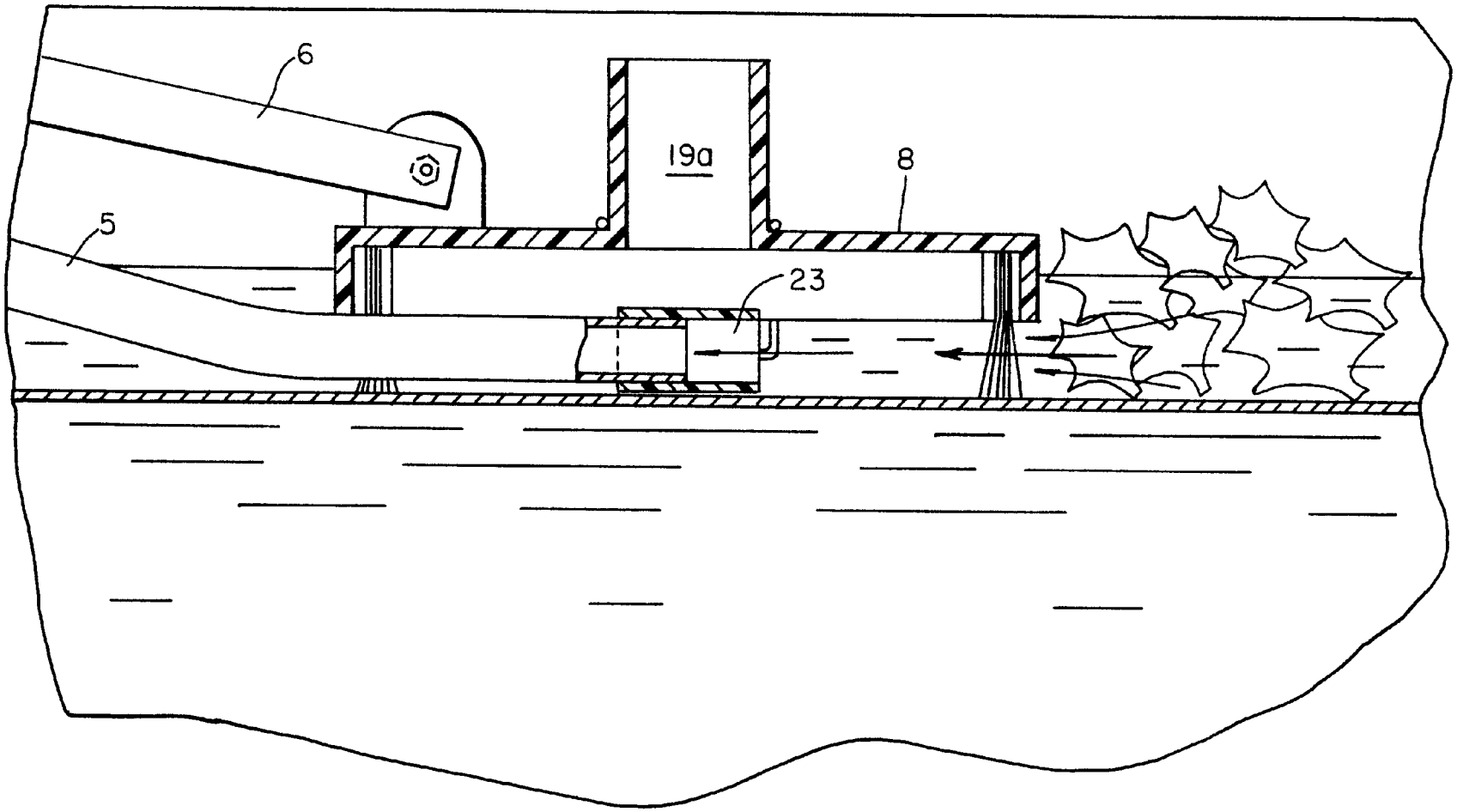
FIG. 6 is a sectional view of the pool cleaner head.

FIG. 4 illustrates a water supply providing water to top 38 of the pool cover creating a body of water 39 on the top of the cover. During this step, additional cleaning materials may be added through the central center section 19 through central tubular aperture member 19*a*. FIG. 5 and FIG. 6 illustrate the flow of water back through the hose. The brush acts as a filtering device for the head of the pool cover cleaner.

In operation, a pool cover having a body of water or no water may be cleaned by the pool cleaner. The hose is connected to a water outlet and the head is positioned on the pool cover. The water is turned on and water flows through the hose to form a body of water on the pool cover until the head is at least partially submerged. The pool cover lies inherently above the ground. The water supply is then turned off and the second hose end is removed from the end of the water outlet and positioned on the ground. As siphoning action takes place, the water in the hose runs back toward the second end drawing water on the pool cover to the second end of the hose and naturally flows onto the ground. The siphoning effect continues to remove water from the pool cover until more air than water fills the hose. During this process the user may brush the surface of the pool cover removing scum and dirt. The brush acts as a filter to prevent leaves from obstructing the flow path of the water.

I claim:

1. A pool cover cleaner for cleaning a pool cover, said pool cover cleaner including a hose having a first end for attachment to a water supply source and a second end for attachment to said pool cover cleaner, said pool cover cleaner comprising:

a handle, said handle secured to said hose by an adjustable band, a pool cover cleaner head, said cleaner head including a housing, said housing having a top surface, a central tubular center section extending above said top surface of said cleaner head, an edge, a bottom surface, a brush, said brush attached to said bottom surface of said cleaner head, and a fluid delivery and removal section, said fluid delivery and removal section secured to said second end of said hose and resiliently attached to said bottom surface of said cleaner head for delivering and removing fluid from a pool cover.

2. The pool cover cleaner of claim 1, said pool cover cleaner further comprising a hand grip section attached to said handle.

3. The pool cover cleaner of claim 1, said housing having a triangular shape.

4. The pool cover cleaner of claim 1, said pool cover cleaner head housing having a central tubular aperture member for supplying additional cleaning fluids.

5. The pool cover cleaner of claim 1, said fluid delivery and removal section including a pair of eyelets and a resilient positioning member secured to said eyelets for attaching said fluid delivery and removal section to said cleaner head.

6. The pool cover cleaner of claim 1, said pool cover cleaner head made of plastic.

* * * * *